US007786398B2

(12) United States Patent
Olbrich et al.

(10) Patent No.: US 7,786,398 B2
(45) Date of Patent: Aug. 31, 2010

(54) COMMAND SWITCH, IN PARTICULAR AN EMERGENCY STOP SWITCH

(75) Inventors: Werner Olbrich, Mühlheim (DE); Michael Schiffmann, Tuchenbach (DE); Bernhard Wiesgickl, Vilseck (DE)

(73) Assignee: Siemens Aktiengesellschaft, Munich (DE)

( * ) Notice: Subject to any disclaimer, the term of this patent is extended or adjusted under 35 U.S.C. 154(b) by 475 days.

(21) Appl. No.: 11/885,560

(22) PCT Filed: Mar. 2, 2006

(86) PCT No.: PCT/EP2006/060401

§ 371 (c)(1),
(2), (4) Date: Sep. 4, 2007

(87) PCT Pub. No.: WO2006/094928

PCT Pub. Date: Sep. 14, 2006

(65) Prior Publication Data

US 2008/0230358 A1 Sep. 25, 2008

(30) Foreign Application Priority Data

Mar. 8, 2005 (DE) ..... 10 2005 010 661

(51) Int. Cl.
*H01H 9/00* (2006.01)

(52) U.S. Cl. ..... 200/334; 200/520; 200/16 A

(58) Field of Classification Search ..... 200/16 R–16 D, 200/520, 530, 537, 538, 540, 541, 329, 330, 200/331, 334, 341
See application file for complete search history.

(56) References Cited

U.S. PATENT DOCUMENTS 3,118,026 A * 1/1964 Pusch et al. ..... 200/16 A (Continued)

FOREIGN PATENT DOCUMENTS

DE 35 33 891 7/1986

(Continued)

OTHER PUBLICATIONS

2007Q16965 Sicherheit von Maschinen—DIN EN 418 NOT-AUS-Einrichtung, funktionelle Aspekte—Gestaltungsleitsätze—Deutsche Fassung EN 418: Oktober 1992.

(Continued)

*Primary Examiner*—Michael A Friedhofer
(74) *Attorney, Agent, or Firm*—Harness, Dickey & Pierce, P.L.C.

(57) ABSTRACT

A command switch or and emergency stop switch is disclosed, which includes an actuator and a contact sensor which is separated therefrom. The actuator includes housing and a tappet, which is guided therein and which has a rest position and an actuation position. The contact sensor includes an open switch element which can be placed in the actuation position by way of the tappet in a tensed position. In at least one embodiment, the command switch also includes an additional switch element which is provided with a first switch piece and a second switch piece, which are applied to the actuator in a separated manner and in/on the contact sensor. The additional switch element only closes when the contact sensor is secured to the actuator. The switch pieces of the additional switch element are separated from each other in a compulsory and advantageous manner by the separated embodiment of the command switch enabling them to be secured to different components of the command switch. An axial or radial misalignment, tilting or rotation between the actuator and the contact sensor leads to the non-conductive connection of the contact piece.

16 Claims, 3 Drawing Sheets

U.S. PATENT DOCUMENTS

| | | | | |
|---|---|---|---|---|
| 6,198,058 | B1 * | 3/2001 | Graninger et al. | 200/50.02 |
| 6,376,785 | B1 * | 4/2002 | Graninger | 200/50.02 |
| 6,987,235 | B2 * | 1/2006 | Sambar et al. | 200/520 |
| 7,232,965 | B2 * | 6/2007 | Gibbons et al. | 200/17 R |
| 7,309,840 | B1 * | 12/2007 | Lo | 200/293 |
| 7,488,914 | B2 * | 2/2009 | Kahnert et al. | 200/538 |
| 7,605,337 | B2 * | 10/2009 | Scherl et al. | 200/405 |

FOREIGN PATENT DOCUMENTS

| | | |
|---|---|---|
| DE | 41 01 493 | 7/1992 |
| DE | 295 17 718 | 12/1996 |
| DE | 299 10 338 | 8/1999 |
| DE | 100 47 998 | 3/2001 |
| DE | 102 23 543 | 11/2003 |
| DE | 20 2004 016 570 | 1/2005 |
| EP | 0 254 161 | 1/1988 |
| EP | 1 109 181 | 6/2001 |
| WO | WO 2004/023501 | 3/2004 |

OTHER PUBLICATIONS

2007Q16971 Mit AS-Interface Sicherheitsmonitor and SIMATIC S7-200 AS-Interface-Master sicherheitsgerichtet schalten—Intemetlink erstellt am Mar. 11, 2005: http://www2.automation.siemens.com/printPreview/microset/html00/products/set7/overview.htm.

* cited by examiner

COMMAND SWITCH, IN PARTICULAR AN EMERGENCY STOP SWITCH

PRIORITY STATEMENT

This application is the national phase under 35 U.S.C. §371 of PCT International Application No. PCT/EP2006/060401 which has an International filing date of Mar. 2, 2006, which designated the United States of America and which claims priority on German Patent Application number 10 2005 010 661.7 filed Mar. 8, 2005, the entire contents of which are hereby incorporated herein by reference.

FIELD

At least one embodiment of the invention relates to a command switch; for example to an EMERGENCY-OFF switch having an actuator and a contact maker which is formed separately from it and can be attached to the actuator. The actuator has a housing and a plunger, which is guided therein, with a rest position and an operated position. The contact maker has a break switching element, which, when in the operated position, can be moved to an open position by way of the plunger.

BACKGROUND

The command switch may, for example, be an EMERGENCY-OFF switch which has a red cap in the form of a pot or mushroom-head. The cap is normally firmly screwed to the plunger. When the command switch is operated, then the plunger of the actuator is moved from the rest position to the operated position. During the process, the plunger necessarily interrupts the contacts of the break switching element, so that the circuit, for example of a connected electrical machine, is broken. Furthermore, depending on the application, further break and make switching elements can be accommodated in the contact maker and are operated jointly via the plunger.

European Standard EN 418 "The Safety of Machines", issued in 1992, also specifies the safety requirements for EMERGENCY-OFF devices. In this context, paragraph 4.1.2 states that the command device and its actuating part must operate on the principle of positive operation. A switch with positive opening is, for example, a suitable command device.

The status of the break switching element can alternatively also be checked by means of a monitoring device in which, for example, a bit pattern is injected via the closed break contacts of the break switching element, and the received result is checked continuously. One such monitoring device is, for example the ASI-F monitoring device from the Siemens Company. This device is also bus compatible, so that, in the absence of the expected bit pattern, installation parts which are accessible for data purposes via a bus can be switched to a safe state.

Furthermore, the command switch is formed in two parts. The capability to separate them is necessary in order to allow the command switch to be attached by way of the actuator, for example to a switching cabinet door, a front panel or a switchboard. By way of example, for this purpose, the actuator is passed through a relatively small hole in a switching cabinet door or the like for installation, and is firmly connected thereto by way of an attachment nut or a clamping ring. The contact maker can then be attached to the actuator, normally by way of a snap-action or screw connection. Thus, the live parts of the command switch are also accommodated, for example, in the switching cabinet.

If the contact maker is not correctly attached to the actuator, for example because the contact maker has not been snapped in correctly, or the screw connection has become released because of vibration, then the contact maker may become detached from the actuator, without this being noticed. An EMERGENCY-OFF circuit then still remains closed, despite the EMERGENCY-OFF switch being operated. The EMERGENCY-OFF switch therefore loses its functionality, and therefore its protective function. This can lead to unpredictable damage to people and installation parts in controlled installations.

DE 41 01 493 A1 discloses, for example, a command switch or an EMERGENCY-OFF switch which allows the function of the contact maker to be monitored.

This has the disadvantage that the contacts of a make contact provided there for monitoring a contact maker may become welded or stuck, so that the fact that the contact maker has become detached from the actuator is not noticed, since the contacts of the make contact still remain closed.

A further disadvantage is that a contact spring which is provided for the make contact and holds the make contact open in the inactive state may break. In this case as well, the fact that the contact maker has become detached from the actuator will not be evident.

SUMMARY

At least one embodiment of the invention therefore specifies a command switch in which incorrect attachment of the contact maker to the actuator can be reliably detected.

In at least one embodiment, a command switch, in particular by an EMERGENCY-OFF switch, includes an actuator and a contact maker which can be attached to the actuator. The actuator has a housing and a plunger, which is guided therein, with a rest position and an operated position. The contact maker has a break switching element which, in the operated position, can be moved to an open position by way of the plunger. Furthermore, the command switch has a further switching element with a first contact piece and a second contact piece, which is fitted separately to the actuator and in/on the contact maker. The further switching element in this case closes, that is to say it becomes electrically conductive, only when the contact maker is correctly attached to the actuator.

An advantage of at least one embodiment of the invention is that the separate configuration of the command switch necessarily results in the contact pieces of the further switching element being disconnected from one another since they are attached to different components of the command switch. In particular, the further switching element and the command switch are formed in two parts. In consequence, the further switching element will also be operable and functional only when the two parts—the actuator and the contact maker—are correctly attached to one another. Any axial or radial offset, tilting or rotation between the actuator and the contact maker will then lead to the contacts of the contact pieces not being conductively connected to one another.

In comparison to the prior art, spot welding or sticking of the contact pieces on the contacts is, in at least one embodiment, advantageously, so to speak, "torn apart" in that the contact maker which has become loose "also drives" the respective contact of its contact piece.

In a first embodiment, the contact pieces of the further switching element are arranged opposite. For this purpose, either the first or the second contact piece is fitted to the housing side of the actuator facing the contact maker, while the second or first contact piece is fitted in or to the contact maker. This advantageously results in good capability to align the contact pieces with one, another.

In one example embodiment, the break switching element and a contact piece of the further switching element are arranged on a printed circuit board in the contact maker. The arrangement of these electrical components allows not only mechanical fixing in or to the contact maker but also an electrical connection, for example with the electrical contacts of different switching elements being connected in series with one another, in a simple manner. Furthermore, the printed circuit board can be pushed into a suitable cutout in the contact maker, in a simple manner.

In a further embodiment of the invention, the first contact piece is formed from at least two contact pins, and the second contact piece is formed from a contact link. In the simplest case, the contact link may be an electrical conductor or else a contact-making surface. When the contact maker is installed correctly on the actuator, this contact link bridges the two contact pins. These two contact pins may, for example, also be passed to the outside of the contact maker, for external connection.

Alternatively, the contact pins can also be accommodated in the actuator housing, in which case the contact pins can be electrically connected to one another. Two contact-making surfaces can be fitted to the contact-maker side, each opposite one contact pin. The contact-making surfaces may, for example, be small circular specific surfaces on a printed circuit board which, for example, are passed to the external connecting contacts on the outside of the contact maker.

The use of contact pins as a part of the further switching element allows contact to be made extremely exactly. If the contact-making area or the contact-making areas of the contact link is or are only slightly larger than the cross-sectional area of a contact pin, then it is possible to advantageously identify very small installation errors, such as radial offsets, tilt, etc. immediately. In situations such as these, a contact-pin tip will no longer be electrically connected to a contact-making surface.

Contact is preferably made with the contact pins in a sprung manner, for example with a spring movement of 1 mm. This can be achieved, for example, by means of a mechanical stop in the contact pin. The spring force of the contact pins advantageously results in an adequate and constant contact-making force between the contact pin and the contact link or contact-making surface. This compensates for any possible manufacturing tolerances between the actuator and the contact maker.

In a further advantageous embodiment, the break switching element and the further switching element are electrically connected in series. Furthermore, only two connecting contacts need advantageously be provided for external wiring. The additional function of installation monitoring is integrated in the command switch according to at least one embodiment of the invention.

Finally, the contact maker can be snapped, locked or screwed to the actuator in an advantageously simple manner. In the event of a fault, a contact maker that has been found to be defective can be unlocked and replaced.

BRIEF DESCRIPTION OF THE DRAWINGS

Example embodiments of the invention will be explained in more detail with reference to the following figures, in which.

DETAILED DESCRIPTION OF THE EXAMPLE EMBODIMENTS

Figure 1:
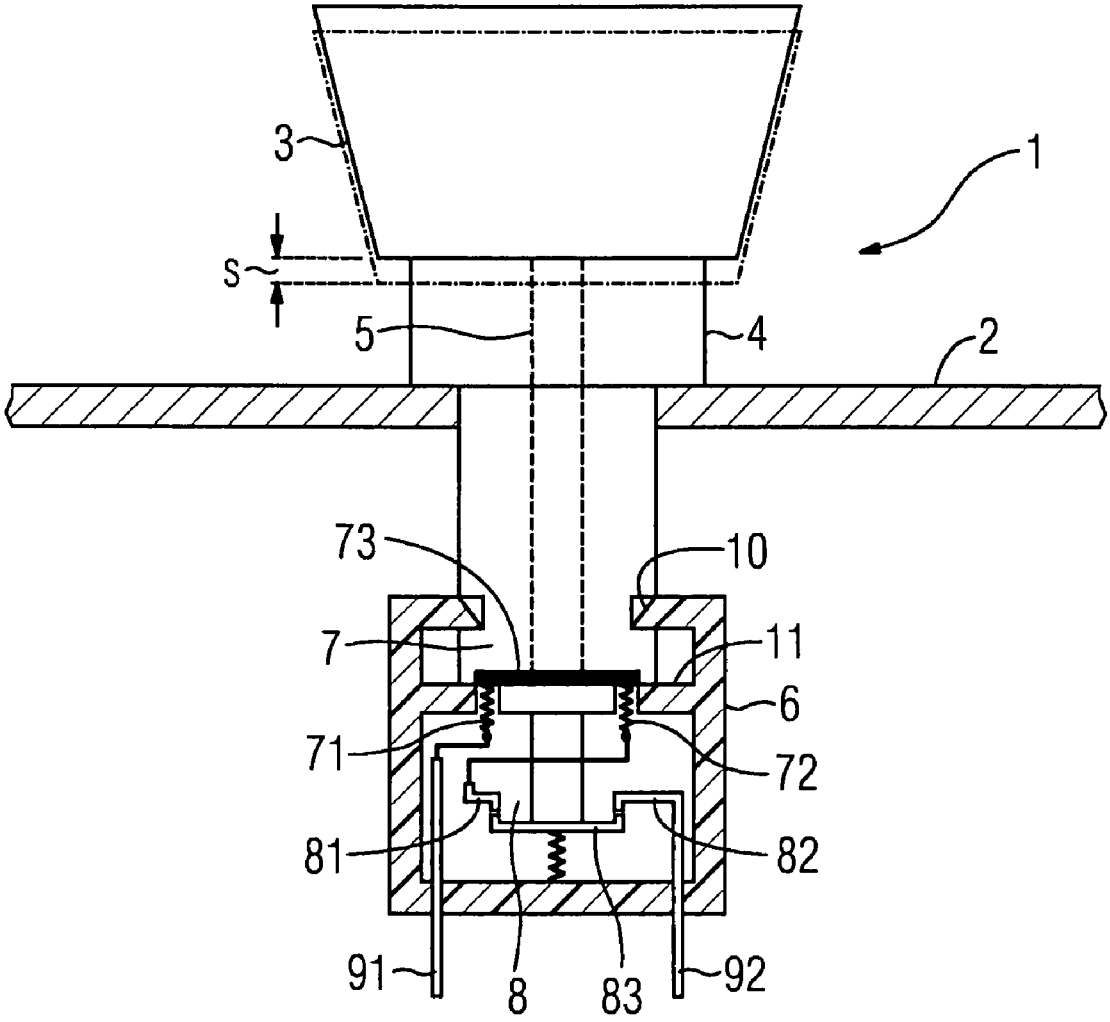
FIG. 1 shows a longitudinal section through one example of an EMERGENCY-OFF switch with a further switching element according to an embodiment of the invention.

FIG. 1 shows a longitudinal section through one example of an EMERGENCY-OFF switch. The other part of the figure shows an actuator 1 whose housing 4 is inserted in an opening and, for example, a front panel 2. For clarity reasons, no clamping ring for attaching the actuator 1 to the front panel 2 is shown. A plunger 5 is guided in the actuator 1 and is firmly connected at an upper end to an EMERGENCY-OFF cap 3.

The actuator 1 and the plunger 5 have a rest position and an operated position. The operated position can in this case be identified from the dashed representation of the lower edge of the EMERGENCY-OFF cap 3. When the EMERGENCY-OFF cap 3 is pressed the operating movement s shown in the figure takes place. This movement distance is also transmitted to the same extent via the plunger 5.

The lower part of the figure also shows a contact maker 6 which is in the form of a box and, for example, is snapped onto the actuator 1. The reference symbol 10 indicates the position of latching tabs which engage in corresponding openings in the housing 4 of the actuator 1. After being snapped in, the contact maker 6 is connected to the actuator 1 with an interlock via, for example, a holding frame 11. The lower end of the plunger 5 now acts on a break switching element 8, which is known per se. In this case, in the operated position, a contact link 83 is disconnected from two contacts 81, 82. An EMERGENCY OFF circuit which is passed via two external connecting contacts 91, 92 is broken in this way.

According to an embodiment of the invention, a further switching element 7 is now provided, comprising a first contact piece 71, 72, and a second piece 73. In the example in the figure, two contact pins 71, 72 form the first contact piece. Both are firmly connected to the housing of the contact maker 6, with the contact pins 71, 72 projecting through corresponding openings in the holding frame 11. The two contact pins 71, 72 are intrinsically sprung, according to one embodiment of the invention. The second contact pin 73 in the example shown in the figure is a contact link which is fitted to the lower end of the housing 4 of the actuator 1.

When the contact maker 6 is fitted, the two contact pins 71, 72 are now located opposite the contact link 73. The contact pins 71, 72 and the contact link 73 are aligned and arranged with respect to one another such that, according to an embodiment of the invention, a conductive connection between the two contact pins via the contact link 73 is made only in the correctly fitted state.

According to one example embodiment of the invention, the break switching element 8 and the further switching element 7 are electrically connected in series. This has already been done in the example shown in the figure. The two external connections 91, 92 therefore allow EMERGENCY-OFF identification and monitoring of the fitting of the contact maker 6 to the actuator 1.

Figure 2:
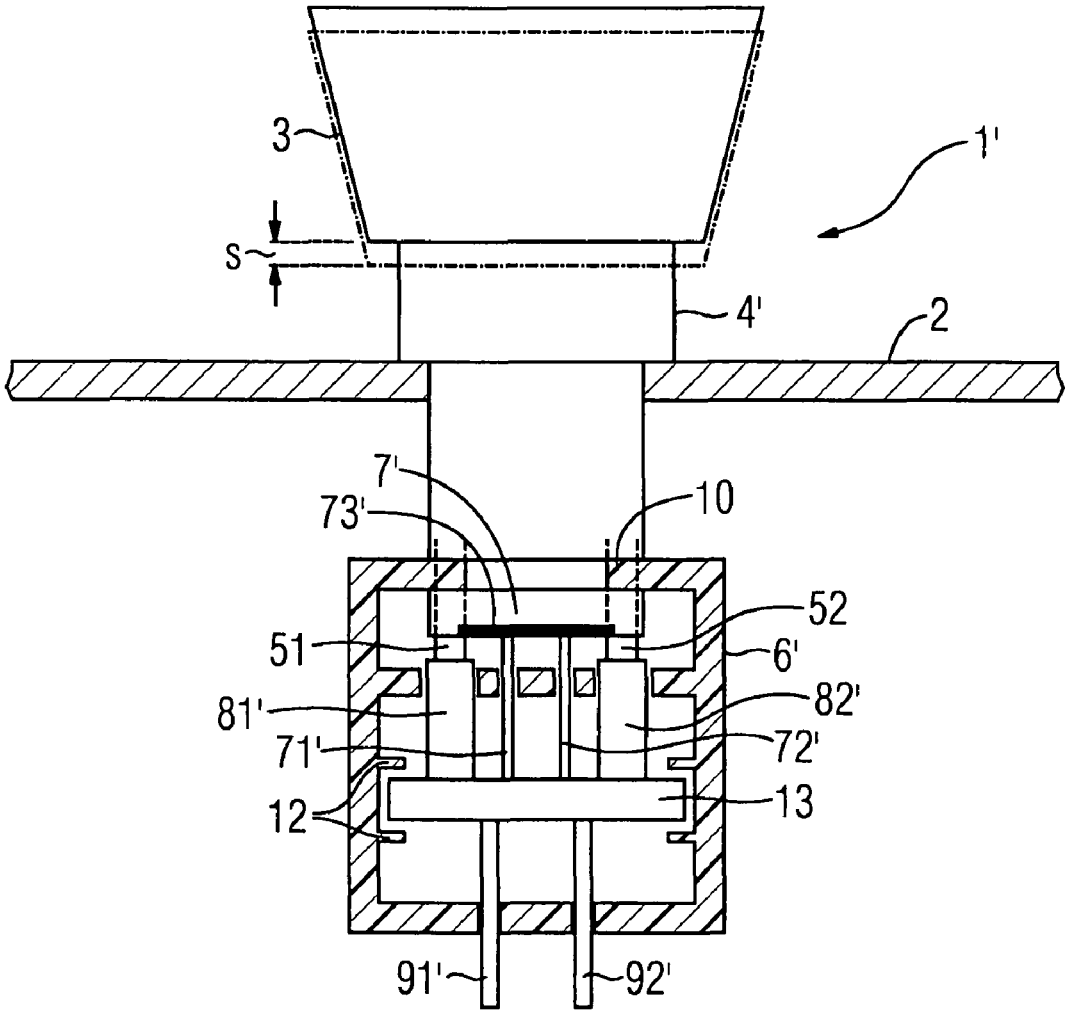
FIG. 2 shows a longitudinal section through a further example of an EMERGENCY-OFF switch with switching elements according to one example embodiment of the invention arranged on a printed circuit board.

FIG. 2 shows a longitudinal section through a further example of an EMERGENCY-OFF switch with switching elements 7', 81', 82' arranged on a printed circuit board 13. The contact maker 6' is illustrated already attached to the housing 4' of the actuator 1'. Holding webs 12 for holding and fixing the printed circuit board 13 are provided in the contact maker 6'. The reference signs 81' and 82' symbolize two break contacts of a break switching element. When an EMERGENCY-OFF occurs, the break contacts 81', 82' can be positively opened by means of a respective plunger 51, 52, with these plungers being mechanically firmly connected to one another. Furthermore, in addition to the break contacts 81', 82', two contact pins 71', 72' are mounted on the printed circuit board 13, where they are soldered in. When the contact maker 6' is fitted correctly, the two contact pins 71', 72' are electrically conductively connected via a contact link 73'. The break contacts 81', 82' and the contact pins 71', 72' are connected in series with one another, so that EMERGENCY-OFF identification and monitoring of the fitting of the contact maker 6' to the actuator 1' are possible via the external connecting contacts 91', 92'.

Figure 3:
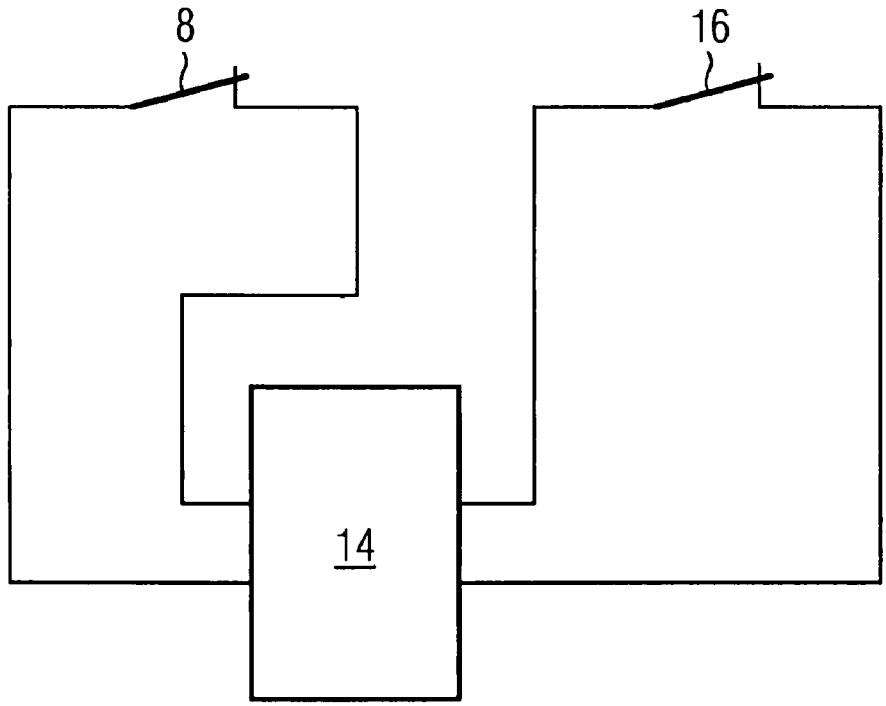
FIG. 3 shows an example of a circuit diagram for monitoring two EMERGENCY-OFF circuits according to the prior art.

FIG. 3 shows a circuit diagram relating to the monitoring of two EMERGENCY-OFF circuits according to the prior art. A monitor 14 monitors, for example, an EMERGENCY-OFF switch with two break switching elements 8, 16. In this case, monitoring of a contact maker 6, 6' for correct fitting is not possible.

Figure 4:
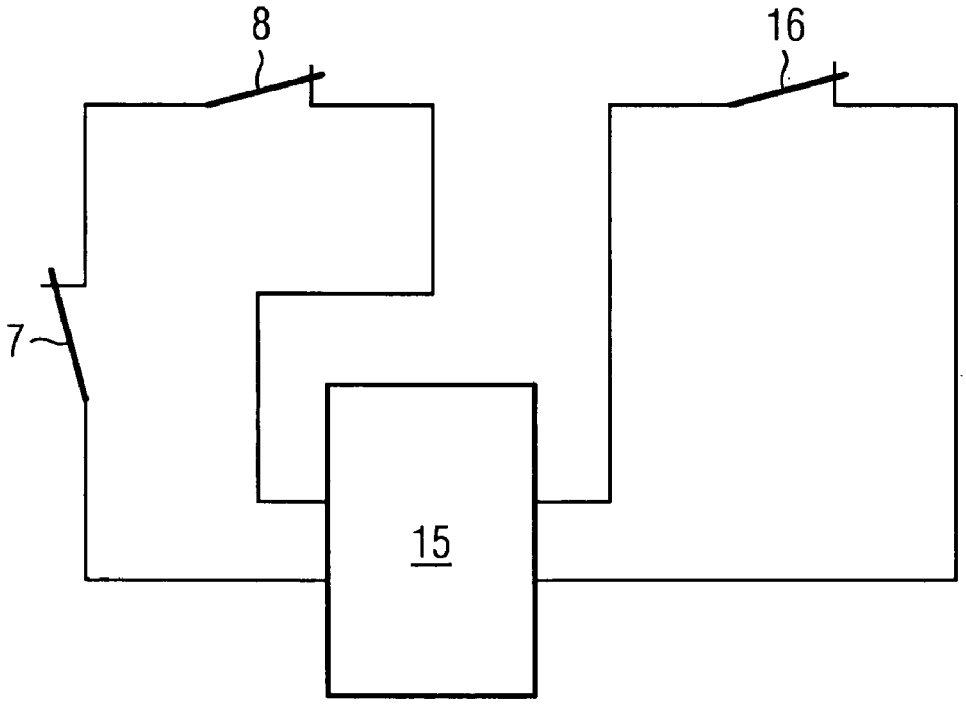
FIG. 4 shows an example of a circuit diagram for monitoring two EMERGENCY-OFF circuits with a conventional EMERGENCY-OFF switch, and with an EMERGENCY-OFF switch according to an embodiment of the invention, as shown in FIG. 1 or FIG. 2.

FIG. 4 shows an example of a circuit diagram of an EMERGENCY-OFF circuit with a conventional EMERGENCY-OFF switch and with an EMERGENCY-OFF switch according to an embodiment of the invention, as shown in FIGS. 1 and 2. A further monitor 15 monitors, for example, an EMERGENCY-OFF switch with two break switching elements 8, 16 and in each case with a further switching element 7. The further switching element 7 is provided with the circuitry symbol for a break contact, in accordance with its function. The series connection according to the invention allows EMERGENCY-OFF identification and identification of a contact maker 6, 6' which has not been fitted correctly. In both cases, the relevant EMERGENCY-OFF circuit is broken so that this allows an electrical machine or other installation parts to be reliably switched off.

Alternatively, the contacts of a break switching element 81, 81', 82, 82' and of a further switching element 71, 71', 72, 721, 73, 73' can also be routed separately, that is to say not connected in series, to external connecting contacts to the contact makers 6, 6'. In this case, a monitoring device can separately monitor the identification of an EMERGENCY-OFF and the identification of an incorrectly fitted contact maker.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A command switch, comprising:

an actuator, including a housing and a plunger, guided therein, with a rest position and an operated position;

a contact maker, attachable to the actuator and including a break switching element, wherein, when the break switching element is in the operated position, the break switching element is movable to an open position by way of the plunger; and a further switching element including a first contact piece and a second contact piece each of which are firmly attached to the housing, the further switching element being fitted separately in the actuator and in the contact maker, such that the further switching element is closed when the contact maker is correctly attached to the actuator.

2. The command switch as claimed in claim 1, wherein the contact pieces of the further switching element are arranged opposite one another.

3. The command switch as claimed in claim 2, wherein the break switching element and a contact piece of the further switching element are arranged on a printed circuit board in the contact maker.

4. The command switch as claimed in claim 2, wherein the first contact piece is formed from at least two contact pins, and the second contact piece is formed from a contact link.

5. The command switch as claimed in claim 4, wherein the contact pins make sprung contact.

6. The command switch as claimed in claim 2, wherein the break switching element and the further switching element are electrically connected in series.

7. The command switch as claimed in claim 2, wherein the contact maker is at least one of snapable, lockable and screwable to the actuator.

8. The command switch as claimed in claim 1, wherein the break switching element and a contact piece of the further switching element are arranged on a printed circuit board in the contact maker.

9. The command switch as claimed in claim 1, wherein the first contact piece is formed from at least two contact pins, and the second contact piece is formed from a contact link.

10. The command switch as claimed in claim 9, wherein the contact pins make sprung contact.

11. The command switch as claimed in claim 1, wherein the break switching element and the further switching element are electrically connected in series.

12. The command switch as claimed in claim 1, wherein the contact maker is at least one of snapable, lockable and screwable to the actuator.

13. The command switch of claim 1, wherein the command switch is an EMERGENCY-OFF switch.

14. The command switch as claimed in claim 1, wherein the first contact piece projects through openings in the contact maker.

15. The command switch as claimed in claim 1, further including at least one external contact that passes through the contact maker and is connected to the break switching element.

16. The command switch as claimed in claim 1, wherein the contact maker includes latching tabs that engage in corresponding openings in the housing.

* * * * *